United States Patent [19]

Watanabe et al.

[11] Patent Number: 4,868,555

[45] Date of Patent: Sep. 19, 1989

[54] FLUORESCENT DISPLAY DEVICE

[75] Inventors: Hiroshi Watanabe; Satoshi Nagasawa, both of Mobara, Japan

[73] Assignee: Futaba Denshi Kogyo K.K., Mobara, Japan

[21] Appl. No.: 131,400

[22] Filed: Dec. 10, 1987

[30] Foreign Application Priority Data

Dec. 26, 1986 [JP] Japan ..... 61-309337

[51] Int. Cl.[4] ..... G09G 3/34

[52] U.S. Cl. ..... 340/783; 340/780; 340/772

[58] Field of Search ..... 340/783, 760, 781, 771, 340/772, 775, 752, 754; 315/169.1, 169.3, 169.4, 169.2; 313/491, 496, 517; 350/350 F

[56] References Cited

U.S. PATENT DOCUMENTS

| | | | |
|---|---|---|---|
| 3,668,466 | 6/1972 | Shimada | 340/781 |
| 3,868,542 | 2/1895 | Tanji | 340/960 |
| 4,218,636 | 8/1980 | Miyazawa | 315/169.1 |
| 4,303,917 | 12/1981 | Kishino et al. | 340/772 |
| 4,325,064 | 4/1982 | Kishino et al. | 340/771 |
| 4,412,213 | 10/1983 | Nishino et al. | 340/772 |
| 4,459,514 | 7/1984 | Morimoto et al. | 340/781 |
| 4,486,749 | 12/1984 | Kishino et al. | 340/772 |
| 4,540,983 | 9/1985 | Morimoto et al. | 340/772 |
| 4,595,862 | 6/1986 | Morimoto et al. | 315/169.1 |
| 4,703,299 | 10/1987 | Nighan et al. | 315/169.4 |

*Primary Examiner*—David K. Moore
*Assistant Examiner*—M. Fatahiyar
*Attorney, Agent, or Firm*—Oblon, Spivak, McClelland et al.

[57] ABSTRACT

A fluorescent display device capable of significantly narrowing intervals between picture cells without narrowing an interval between each adjacent two control electrodes to exhibit a display with high resolution and simplifying its structure. The fluorescent display device includes a signal generating circuit for supplying control electrode drive signals different in voltage to a pair of selected control electrodes to control a display.

7 Claims, 5 Drawing Sheets

FLUORESCENT DISPLAY DEVICE

BACKGROUND OF THE INVENTION

1. Field of the Invention

This invention relates to a fluorescent display device which effects luminous display of letters, images and the like, and more particularly to a fluorescent display device which selects picture cells to be illuminated by driving a pair of adjacent control electrodes.

2. Description of the Prior Art

A variety of display units including a cathode ray tube, a liquid crystal display device, a fluorescent display device and the like have been conventionally used to display letters, figures, images and the like. These display units are desirable to be thin and exhibit high resolution. In the fluorescent display device which is inherently advantageous in low power consumption, good visibility, a thinner shape and the like, much efforts have been made in order to obtain a display with high resolution.

FIGS. 4(*a*) and 4(*b*) show a general structure of fluorescent display device which includes control electrodes, each pair of adjacent control electrodes being concurrently selected and driven.

The fluorescent display device shown in FIGS. 4(*a*) and 4(*b*) includes an insulating substrate 1, strip-like anodes 2 arranged on the substrate 1 so as to extend in parallel to each other and a phosphor 3 deposited all over each of the anodes 2. In addition, insulating spacers 4 are arranged on the substrate 1 so that control electrodes 5 may be supported in a manner to be crossedly stretched above the anodes 2. Sections of the anodes interposed between each adjacent two control electrodes 5 each form a picture cell P. Each of the control electrodes 5 is connected at one end thereof to an electrode terminal 6 formed on the substrate 1. Above the control electrodes 5 are arranged filamentary cathodes 8 which serve as an electron source for emitting electrons. The fluorescent display device also includes a casing 9 formed of a transparent material, which is hermetically sealed on the substrate 1 by means of a frit glass 7 to form a vacuum envelope. The anodes 2 and cathodes 8 are connected to terminals (not shown) provided at the outside of the envelope. The fluorescent display device thus constructed is driven by applying a display signal to each of the anode electrodes 2 and energizing the respective pairs of adjacent two control electrodes 5 in order synchronous with the application of the display signal to the anode electrode. This causes the picture cells P to give off light emission so as to effect a desired display.

Operation of the fluorescent display device will be described in detail with reference to FIG. 5 which shows a drive circuit for the fluorescent display device shown in FIG. 4.

In FIG. 5, control electrodes of odd number $5_1$–$5_{n-1}$ are connected to an output section of a first control electrode drive circuit 102 and control electrodes of even number $5_2$–$5_n$ are connected to an output section of a second control electrode drive circuit 103. The control electrode drive circuits 102 and 103 may be constructed in a manner known in the art, such as, for example, a shift registor. Anodes $2_l$–$2_m$ are connected to an output section of an anode drive circuit 101. The anode drive circuit 101 may be constructed in a manner known in the art which comprises a shift resistor acting as an input section and a latch acting as the output section which are connected together in series. A timing control circuit 104 serves to control timing of the control electrode drive circuits 102 and 103 and anode drive circuit 101. The timing control circuit 104 supplies complementary clock pulses $CP_1$ and $CP_2$ to clock input terminals of the control electrode drive circuits 102 and 103, respectively, and also supplies a timing pulse TP to the anode drive circuit 101. To an input section of the anode drive circuit 101 is supplied a display signal indicating a letter, an image or the like.

FIG. 6 is a timing chart of the circuit shown in FIG. 5.

Operation of the circuit shown in FIG. 5 will be further described with reference to FIG. 6.

When the complementary pulses $CP_1$ and $CP_2$ are generated from the control circuit 104 at a time $t_0$, the control electrode drive circuit 102 supplies a signal of a high level to the control electrode $5_1$ in response to a rising edge of the pulse $CP_1$. Then, at a time $t_1$, the control electrode drive circuit 103 supplies a signal of a high level to the control electrode $5_2$ in response to a rising edge of the pulse $CP_2$. In synchronism with selective driving of the control electrodes $5_1$ and $5_2$ at the same voltage of a high level, the anode drive circuit 101 supplies a signal corresponding to a display signal Vs to the anodes $2_1$-$2_m$. This causes parts of picture cells $P_{11}$-$P_{1m}$ corresponding to the display signal Vs to emit light so as to complete a display of a first row. At a time $t_2$, the control electrode drive circuit 102 supplies a signal of a high level to the control electrode $5_3$ in response to a rising edge of the clock pulse $CP_1$, thereby the control electrodes $5_2$ and $5_3$ maintaining the same voltage of a high level are selected. In synchronism with such selection, a signal corresponding to a display signal Vs on a second row is supplied through the anode drive circuit 101 to the anodes $2_1$–$2_m$, thereby the corresponding parts of the picture cells $P_{2l}$-$P_{2m}$ give forth light emission. In a similar manner, the remaining picture cells are selectively driven for light emission so as to effect a display of an image or the like.

In the fluorescent display device selectively driven the respective pairs of adjacent control electrodes in order at high level signals of the same voltage, a display with high resolution is effected by forming each control electrode using a fine wire and arranging the control electrodes at narrow intervals so that intervals between adjacent picture cells may be narrow.

However, this results in intervals between the control electrodes to be equal to those between the picture cells. Thus, arrangement of the picture cells at intervals as small as 0.2 mm or less causes short-circuiting and a failure in insulation between adjacent control electrodes. An attempt to solve such a problem in the manufacture of the fluorescent display device requires a great deal of skill in the manufacture and assembly of the control electrode and the assembly of the fluorescent display device, and causes deterioration of yield in the manufacture.

SUMMARY OF THE INVENTION

The present invention has been made in view of the foregoing disadvantage of the prior art.

Accordingly, it is an object of the present invention to provide a fluorescent display device which is simple in structure and easy to manufacture.

It is another object of the present invention to provide a fluorescent display device which exhibits a high resolution.

In accordance with the present invention, a fluorescent display device is provided. The fluorescent display device is adapted to supply control electrode drive signals to each pair of selected adjacent control electrodes to carry out a desired display. The fluorescent display device includes signal generating means for supplying control electrode drive signals different in voltage to each pair of the selected control electrodes.

In the present invention, electrons passing through the control electrodes are biased by differentiating voltages applied to a pair of the selected control electrodes from each other, thereby driving a plurality of picture cells by a pair of the control electrodes.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein:

FIG. 2(*b*) is a timing chart showing a second embodiment of a fluorescent display device according to the present invention;

DETAILED DESCRIPTION OF THE PREFERRED EMBODIMENT

Now, a fluorescent display device according to the present invention will be described with reference to FIGS. 1 to 3.

Figure 1:
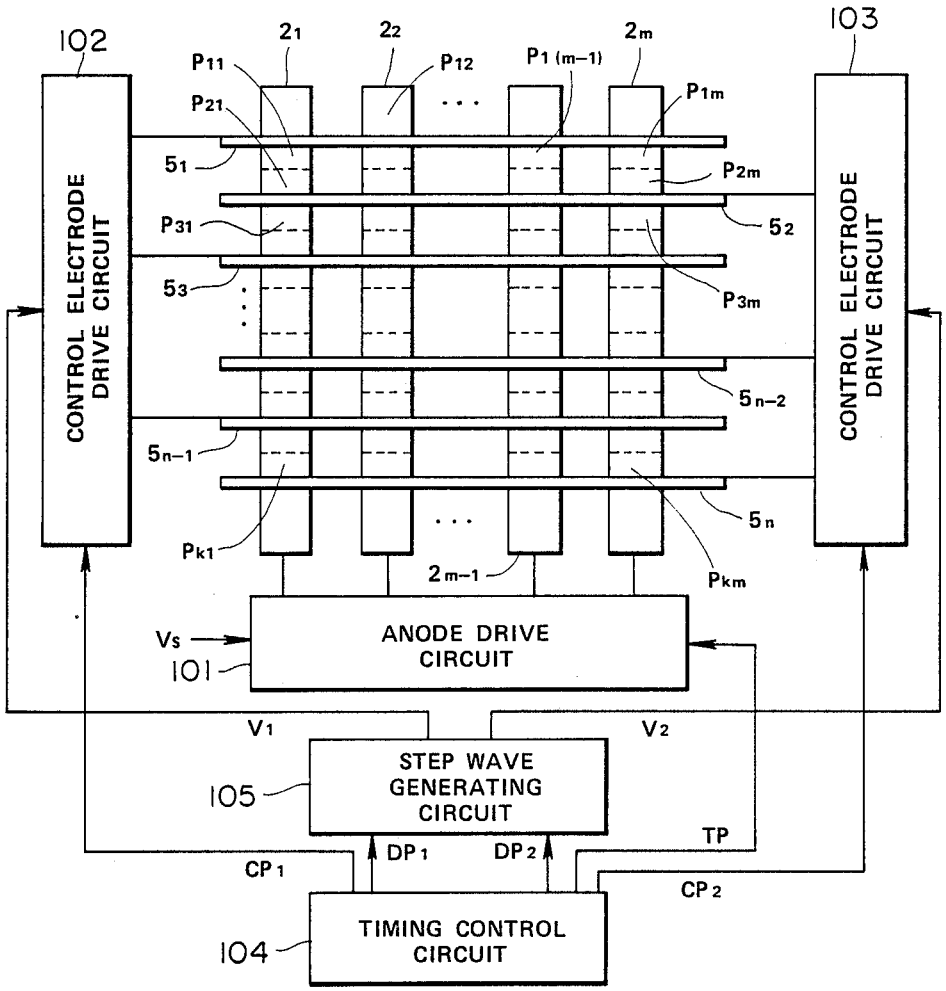
FIG. 1 is a block diagram showing a general structure of a fluorescent display device according to the present invention.
Figure 5:
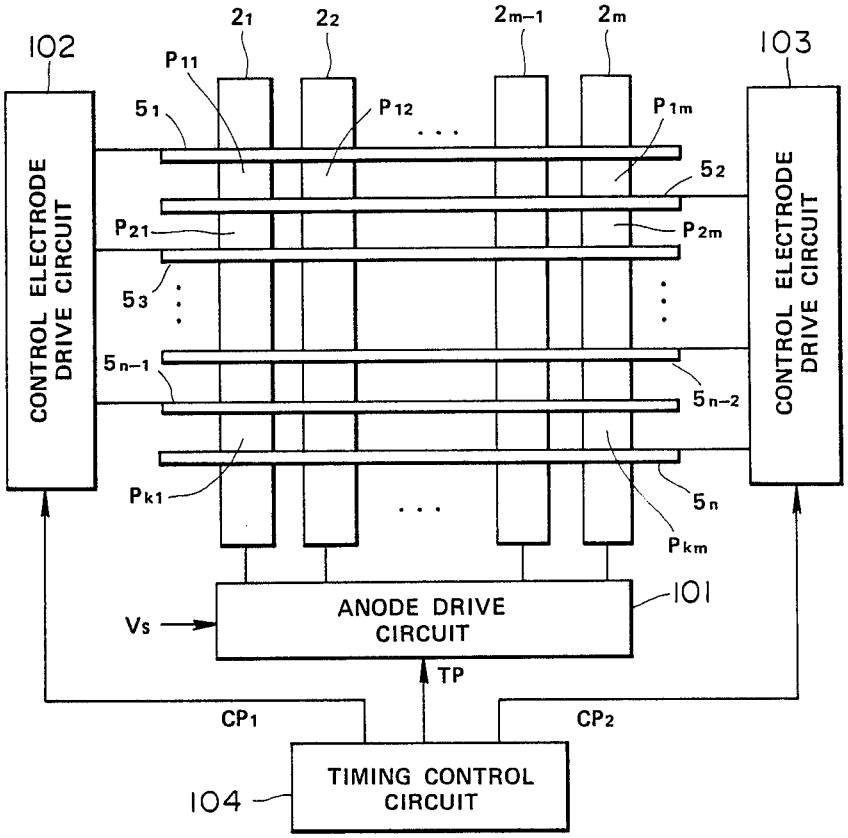
FIG. 5 (PRIOR ART)
FIG. 5 is a block diagram of the fluorescent display device shown in FIG. 4.

FIG. 1 is a block diagram showing a general structure of a fluorescent display device according to the present invention, wherein the same reference numerals as in FIG. 5 indicate corresponding parts.

In FIG. 1, linear control electrodes of odd number $5_1$–$5_{n-1}$ are connected to an output section of a control electrode drive circuit 102, and linear control electrodes of even number $5_2$–$5_n$ are connected to an output section of a control electrode drive circuit 103. Linear or strip-like anodes $2_1$–$2_m$ each having a phosphor deposited all thereover are connected to an output section of an anode drive circuit 101. To an input section of the anode drive circuit 101 is supplied a display signal Vs indicating a letter, an image or the like. To clock input terminals of the control electrode drive circuits 102 and 103 are supplied complementary clock pulses $CP_1$ and $CP_2$ from a timing control circuit 104, respectively. To the anode drive circuit 101 is supplied a timing pulse TP from the timing control circuit 104. Also, the timing control circuit 104 supplies complementary voltage control pulses $DP_1$ and $DP_2$ to a step wave generating circuit 105. The step wave generating circuit 105 has two output sections connected to power terminals of the control electrode drive circuits 102 and 103, respectively. The remaining part of the fluorescent display device shown in FIG. 1 may be constructed in such a manner as described in connection with FIG. 5.

Figure 2:
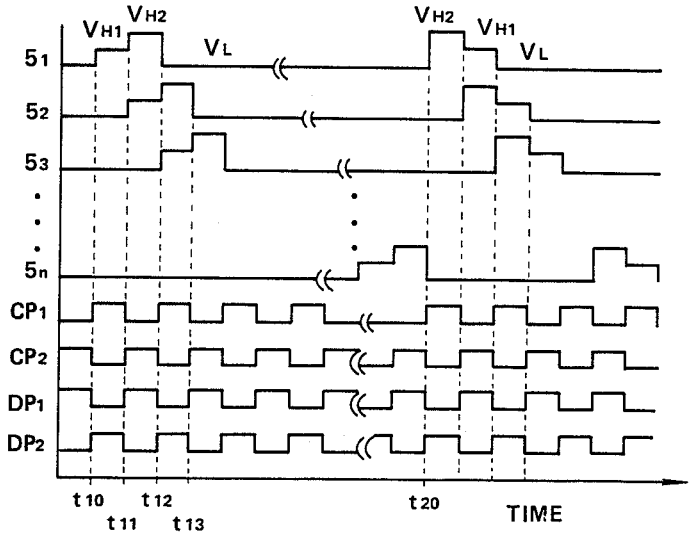
FIG. 2(*a*) is a timing chart showing a first embodiment of a fluorescent display device according to the present invention.
Figure 2:
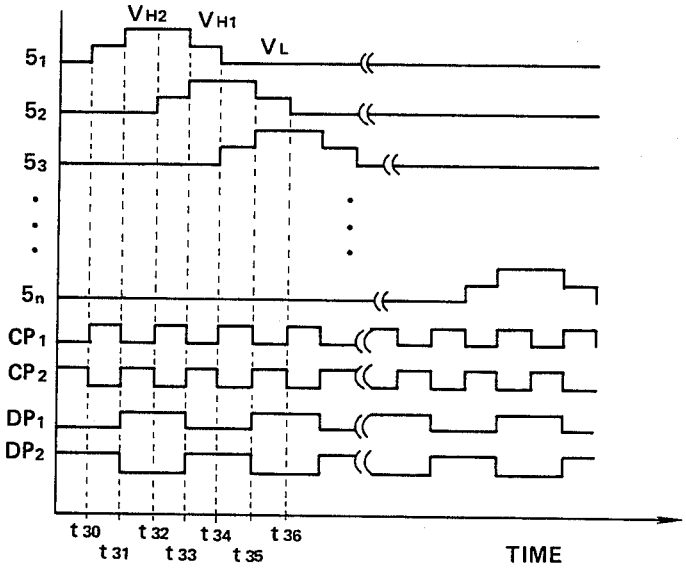
Figure 3:
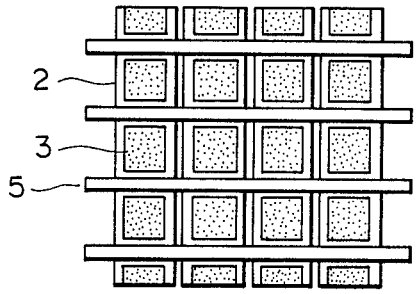
FIG. 3 is a fragmentary plan view showing an essential part of a modification of the present invention.
Figure 6:
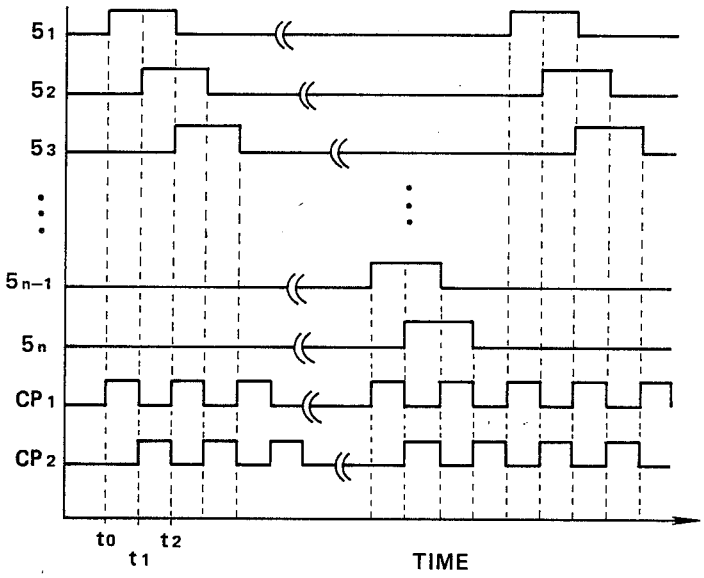
FIG.6 (PRIOR ART)
FIG. 6 is a timing chart of the fluorescent display device shown in FIG. 4.
Figure 4A:
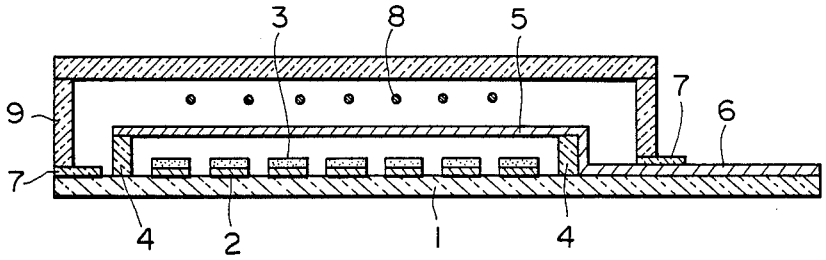
FIGS. 4(*a*) and 4(*b*) are a sectional side view and a fragmentary plan view showing a general structure of a conventional fluorescent display device, respectively.
Figure 4B:
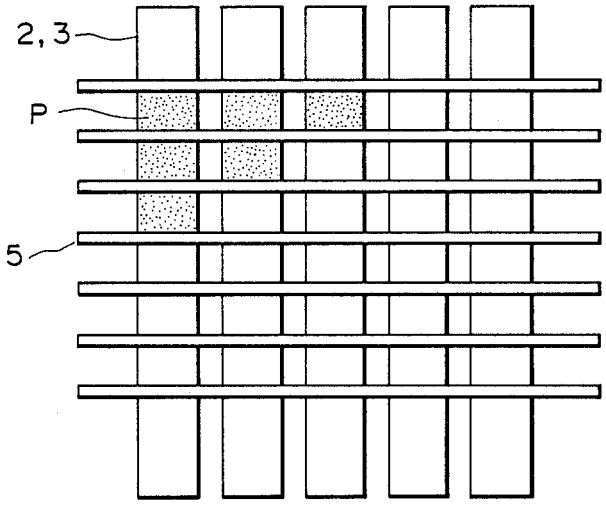

FIGS. 2(*a*) and 2(*b*) are timing charts showing first and second embodiments of the fluorescent display device shown in FIG. 1, wherein wave forms of voltage applied to the control electrodes $5_1$–$5_n$ and other pulses are indicated. In each of the embodiments, three kinds of voltage signals are supplied to the control electrodes $5_1$–$5_n$. For example, supposing that anode voltage is set at 130V, control voltage is applied to the control electrodes $5_1$–$5_n$ at a low level $V_L$ of −10V, a first high level $V_{H1}$ of 80V and a second high level $V_{H2}$ of 100V.

Now, the first and second embodiments will be described with reference to FIGS. 1 and 2.

First, the first embodiment will be described with reference to FIGS. 1 and 2(*a*). At a time $t_{10}$, complementary clock pulses $CP_1$ and $CP_2$ are supplied from the timing control circuit 104 to the control electrode drive circuits 102 and 103, and voltage control pulses $DP_1$ and $DP_2$ are supplied from the timing control circuit 104 to the step wave generating circuit 105. The control electrode drive circuit 102 supplies a signal of a level determined depending on its source voltage to the control electrode $5_1$ in response to a rising edge of the clock pulse $CP_1$. An output signal $V_1$ of the step were generating circuit 105 is increased to a first high level $V_{H1}$ in response to the voltage control pulse $DP_1$ of a low level so as to apply voltage of the first high level $V_{H1}$ to the control electrode $5_1$.

At a time $t_{11}$, the voltage control pulse $DP_1$ of a high level is supplied from the timing control circuit 104 to the step wave generating circuit 105, to thereby cause the output signal $V_1$ of the step wave generating circuit 105 to be increased to a second high level $V_{H2}$. Accordingly, voltage of the second high level $V_{H2}$ is supplied from the control electrode drive circuit 102. Concurrently, the control electrode drive circuit 103 supplies a signal corresponding to voltage supplied to its power terminal to the control electrode $5_2$ in response to a rising edge of the clock pulse $CP_2$. Also, an output signal $V_2$ of the step wave generating circuit 105 is increased to the first high level $V_{H1}$ in response to the voltage control pulse $DP_2$ of a low level so that voltage of the first high level $V_{H1}$ may be supplied to the control electrode $5_2$. At this time, to the control electrodes $5_1$ and $5_2$ are supplied control electrode drive signals of the levels $V_{H1}$ and $V_{H2}$, respectively, so that electrons emitted from cathodes may be biased toward the control electrode $5_1$ and directed to picture cells $P_{11}$–$P_{1m}$ of a first row which are defined by portions of the anodes $2_1$–$2_m$ interposed between dotted lines and the control electrodes $5_1$ in FIG. 1. Also, synchronously a timing pulse TP is supplied from the timing control circuit 104 to the anode drive circuit 101 so that the anode drive circuit 101 may supply an anode electrode drive signal corresponding to a display signal Vs to the anodes $2_1$–$2_m$. This causes only parts of the picture cells $P_{11}$–$P_{1m}$ corresponding to the supplied anode drive signal to emit light, thereby a display of the first row is completed.

Then, at a time $t_{12}$, the control electrode drive circuit 102 shifts in response to a rising edge of the clock pulse $CP_1$ to supply a signal corresponding to its source voltage to the control electrode $5_3$. The step wave generating circuit 105 supplies the output signal $V_1$ of the level $V_{H1}$ and the output signal $V_2$ of the level $V_{H2}$ to the control electrode drive circuits 102 and 103 depending on the voltage control pulse $DP_1$ of a low level and the voltage control pulse $DP_2$ of a high level, respectively. Accordingly, voltage of the level $V_{H1}$ and voltage of the level $V_{H2}$ are applied to the control electrodes $5_2$ and $5_3$, respectively. Synchronously, the timing pulse TP is supplied from the timing control circuit 104 to the anode drive circuit 101 so that an anode drive signal corresponding to the display signal Vs may be supplied to the anodes $2_l$–$2_m$. This causes parts of picture cells $P_{31}$-$P_{3m}$coresponding to the display signal Vs to carry out light emission, thereby a display of a third row being completed.

Similar operation is repeated to accomplish a display of each of the rows of odd-number up to a row K.

After a time $t_{20}$, the step wave generating circuit 105 generates a step wave signal in which a signal component of the second high level $V_{H2}$ and a signal component of the first high level $V_{H1}$ repeatedly appear. The other elements operate in the same manner as described above. Thus, a display of each of the picture cells of even number is carried out, thereby a display of one picture plane is completed.

The above-described operation is repeated to carry out an interlace type display.

Now, the second embodiment will be described with reference to FIGS. 1 and 2(*b*).

The second embodiment is adapted to carry out a linear sequential type display which is different from the interlace type display of the first embodiment described above. The second embodiment includes the same circuit as shown in FIG. 1, however, the control electrodes $5_l$–$5_n$each are driven at a timing shown in FIG. 2(*b*).

In operation, signals generated between times $t_{30}$ and $t_{32}$ are ignored, and each of the control electrodes $5_1$–$5_n$is driven by signals generated after a time $t_{32}$. Between the time $t_{32}$ and a time $t_{33}$, voltage of a second high level $V_{H2}$ is supplied to the control electrode $5_1$ and voltage of a first high level $V_{H1}$ is supplied to the control electrode $5_2$. Accordingly, parts of picture cells $P_{11}$–$P_{1m}$ corresponding to a display signal Vs are caused to emit light. Thus, the second embodiment carries out a display of one picture place in a linear sequential manner.

As is apparent from the first and second embodiments described above, the present invention is so constructed that each pair of the selected adjacent control electrodes may exhibit function of selecting a plurality of picture cells as well as function of biasing electrons. Such construction significantly narrows intervals between the picture cells without narrowing an interval between each adjacent two control electrodes and exhibits a display with high resolution and also simplify a structure of the fluorescent display device. Furthermore, the number of the terminals of the control electrode drive circuit can be decreased, which permits the fluorescent display device to be manufactured with ease.

The present invention may be modified in various way. For example, deposition of the phosphor all over the anode often causes bleeding at an edge of the picture cell. In order to prevent such a problem, dot-like phosphors 3 may be deposited on each of strip-like anodes 2 as shown in FIG. 3. Also, the control electrodes may be formed on a projection-like insulating layer arranged between each adjacent phosphors so as to extend in a direction perpendicular to the anodes by deposition or the like.

While preferred embodiments of the invention have been described with a certain degree of particularlity with reference to the drawings, obvious modification and variations are possible in the light of the above teachings. It is therefore to be understood that within the scope of the appended claims, the invention may be practiced otherwise than as specifically described.

What is claimed as new and desired to be secured by Letters Patent of the United States is:

1. A fluorescent display device comprising:

a plurality of phosphor-deposited anode electrodes arranged so as to extend in parallel to each other;

a plurality of control electrodes arranged in a direction crossing said anode electrodes;

an electron emitting source means placed apart from said control electrodes for emitting electrons;

an envelope for receiving said anode electrodes, control electrodes and electron emitting source therein;

anode drive means for applying a display signal to each of said anode electrodes;

control electrode drive means for simultaneously supplying a control electrode drive signal to a pair of adjacent control electrodes selected; and signal generating means for supplying control electrode drive signals different in voltage to a pair of said selected control electrodes.

2. The fluorescent display device as defined in claim 1, wherein said signal generating means comprises a timing control circuit and a step wave generating circuit.

3. The fluorescent display device-as defined in claim 2, wherein said timing control circuit generates complementary voltage clock pulses to be supplied to said control electrode drive means and complementary voltage control pulses to be supplied to said step wave generating circuit for generating output signals in response to said voltage control pulses.

4. The fluorescent display device as defined in claim 3, wherein said complementary voltage control pulses consist of a low level voltage control pulse and a high level voltage control pulse.

5. The fluorescent display device as defined in claim 3, wherein said control electrode drive means generates a signal to be supplied to said control electrode in response to a rising edge of said clock pulses.

6. The fluorescent display device as defined in claim 4, wherein said step wave generating circuit generates a first high level output signal in response to said low level voltage control pulse supplied to said step wave generating circuit from said timing control circuit to be supplied to said control electrodes.

7. The fluorescent display device as defined in claim 4, wherein said wave generating circuit generates a second high level output signal in response to said high level voltage control pulse supplied to said wave generating circuit from said timing control circuit to be supplied to said control electrodes.

* * * * *